US005566694A

United States Patent [19]

Pugh et al.

[11] Patent Number: 5,566,694

[45] Date of Patent: Oct. 22, 1996

[54] CONTINUOUS PICKLING TANK WITH EXPANDABLE SEALS

[75] Inventors: William H. Pugh, Pittsburgh, Pa.; Dieter Kottzieper, Mansfield, Ohio

[73] Assignees: Allegheny Plastics, Inc., Leetsdale, Pa.; Ecopic Corporation, Mansfield, Ohio

[21] Appl. No.: 478,876

[22] Filed: Jun. 7, 1995

[51] Int. Cl.[6] ..... B08B 3/08

[52] U.S. Cl. ..... 134/64 R; 134/104.1; 134/122 R; 266/112; 277/56

[58] Field of Search ..... 134/64 R, 122 R, 134/104.1; 266/111, 112, 113, 114, 120; 277/53, 56

[56] References Cited

U.S. PATENT DOCUMENTS

| | | | |
|---|---|---|---|
| 2,650,599 | 9/1953 | Campbell | 134/64 R |
| 3,625,232 | 12/1971 | Speelmanns et al. | 134/122 R |
| 4,807,653 | 2/1989 | Cipriano et al. | 134/64 R |
| 4,901,744 | 2/1990 | Hansen | 134/64 R |
| 4,950,333 | 8/1990 | Hone et al. | 134/15 |
| 4,986,291 | 1/1991 | Hula et al. | 134/122 R |
| 4,996,998 | 3/1991 | Seiz et al. | 134/60 |
| 5,116,447 | 5/1992 | Kimura et al. | 156/345 |
| 5,248,372 | 9/1993 | McNamee | 156/345 |
| 5,282,485 | 2/1994 | Hirai et al. | 134/64 R |
| 5,412,966 | 5/1995 | Neese et al. | 72/37 |

*Primary Examiner*—Philip R. Coe

*Attorney, Agent, or Firm*—Webb Ziesenheim Bruening Logsdon Orkin & Hanson, P.C.

[57] ABSTRACT

The present invention discloses a continuous, shallow bath plastic pickling tank for carbon or stainless steel strip or product. The present invention provides first and second end stands spaced from each other and secured to a foundation with a trough extending between the end stands anchored at the center and adapted to receive a pickling acid therein. An expandable seal according to the present invention couples each end stand with the trough with the seal specifically allowing for the thermal expansion of the trough relative to the stands while prohibiting the escape of pickling acid or fumes. The invention includes a device to allow for cleaning of the seal with cleaning fluid such as flushing water.

19 Claims, 4 Drawing Sheets

CONTINUOUS PICKLING TANK WITH EXPANDABLE SEALS

BACKGROUND OF THE INVENTION

1. Field of the Invention

The present invention relates to a pickling tank for products such as metal band or strip. More specifically, the present invention relates to a substantially plastic pickling tank containing expandable seals allowing for thermal expansion of the trough section of the pickling tank.

2. Background Information

A large variety of pickling apparatuses have been devised for pickling sheet material such as carbon and stainless steel strip. Examples of these devices can be found in U.S. Pat. Nos. 2,650,599; 3,625,232; 4,950,333; 5,116,447; 5,248,372 and 5,412,966. Additionally, a wide variety of shallow bath pickling or turbulent bath pickling devices have been developed. As the name implies, the shallow bath pickling apparatuses are not as deep as conventional pickling baths and generally have a plurality of spray nozzles pumping pickling acid over the work product. The shallow bath pickling devices generally require a pickling acid supply system as well as a pickling acid recirculation system. The constant movement of the acid on the strip within the shallow bath pickling device provides a mechanical scrubbing action to help remove the scale off the workpiece. Additionally, the pickling acid is more homogeneous throughout a shallow pickling bath. However, a shallow bath pickling device must pump a significant amount of pickling acid through the bath. Samples of shallow bath pickling devices can be found in U.S. Pat. Nos. 4,807,653; 4,996,998 and 5,282,485.

As described in U.S. Pat. No. 4,901,744, pickling bath tanks have historically been made out of metal or granite which have significant drawbacks in cost, weight and lack of corrosion resistance of the resulting pickling tank. Additionally, due to elevated operating temperatures, the tanks undergo thermal expansion during use. Corrosion-resistant plastic tanks will expand to a greater degree than metal or granite tanks. The prior art patents do not significantly provide for expansion joints allowing for expansion of the troughs while preventing the escape of pickling acid. Any large amount of tank expansion can detrimentally affect the relative positioning of the tank and workpiece wringing/support rolls.

An object of the present invention is to overcome the aforementioned drawbacks of the prior art. It is a further object of the present invention to provide a cost-effective shallow bath plastic pickling tank, including expandable seals which allow for thermal expansion of the trough and which further prevent the escape of pickling acid. A further object of the present invention is to provide a seal which prevents the escape of both pickling acid liquid and fumes through the seal.

SUMMARY OF THE INVENTION

The objects of the present invention are achieved by providing a continuous or push/pull-type, shallow bath plastic pickling tank which includes at least first and second end stands spaced from each other and secured to the foundation. A trough extends between each stand and is adapted to receive pickling acid and work product therein. The trough may be anchored to the foundation at the center of the trough to equalize expansion of the trough on each side of the anchor. An expandable seal connects each stand with the trough with the seal allowing for thermal expansion of the trough relative to the fixed stands.

The present invention may further include a third end stand spaced from the second end stand and also secured to the foundation with a second trough extending between the second end stand and third end stand. Further troughs may be provided in a similar fashion. The provision of additional troughs allows for the pickling tank to be built to a desired length and to provide different operating sections as needed. The present invention will substantially maintain a separation between the pickling acid in the first trough and the pickling acid in the second and subsequent troughs.

In the disclosed embodiment of the present invention, each trough and each end stand are formed substantially of stress-relieved, virgin polypropylene (PP). The construction of the pickling tank out of polypropylene provides cost savings, corrosion resistance and other advantages to the present invention. However, the use of a plastic trough highlights the need for an expandable seal since a 40–60 foot trough length may expand 3–5 inches under operating conditions. Other appropriate thermoplastic material may be utilized such as PVC, CPVC and PE.

The expansion seals of the present invention are preferably formed as labyrinth seals extending at least along the bottom and two sides of each trough. Each labyrinth seal may be formed of four pieces, including an end flange and an intermediate flange extending from the trough and an inner flange and plenum chamber extending from the end stand. The flanges and plenum chamber are arranged to overlap each other to form the labyrinth seal. A flushing connection is provided to permit intermittent flushing of the labyrinth seal with a cleaning fluid such as water. The inner flange is lower than the outer fume plenum to direct this water into the interior of the fixed stand. The use of the flushing coupling to clean out the labyrinth seals will prevent the buildup of material within the seals through crystallization of the pickling acid. The labyrinth seal further includes a plurality of weep holes extending into an interior of the end stand across the inner flange. The fume plenum is positioned at an exterior of the labyrinth seal with the fume plenum including a plurality of fume entrance holes therein. The fume plenum is adapted to be coupled to a device for drawing fumes through the fume plenum, such as a suction fan.

Each end stand may include a drain positioned therein with at least a portion of the bottom surface of an interior of each end stand being sloped toward the drain. Additionally, the trough may include a trough drain with the bottom surface of the trough sloped toward the trough drain. The drains are adapted to be coupled to a recirculation system associated with the pickling tank.

These and other advantages of the present invention will be clarified in the description of the preferred embodiment together with the attached figures.

BRIEF DESCRIPTION OF THE PREFERRED EMBODIMENT

Figure 1:
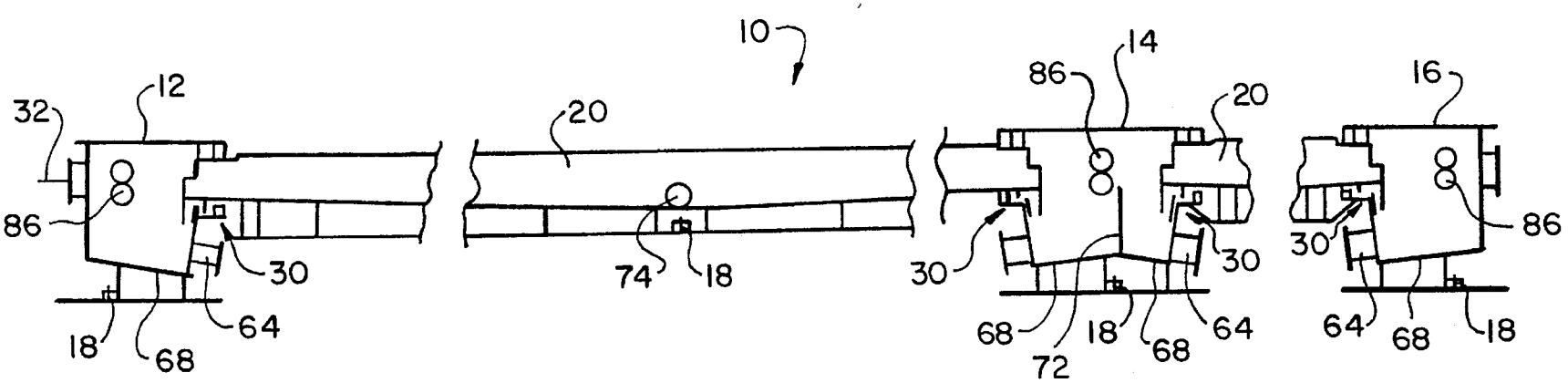
FIG. 1 is a schematic side view of the continuous pickling tank according to the present invention.

FIG. 1 illustrates a side view of a continuous pickling tank 10 according to the present invention. The pickling tank 10 includes a first end stand 12 at an entry side of the pickling tank 10, a second end stand 14 spaced from the stand 12 and a third end stand 16 spaced from the stand 14. The stands 12, 14 and 16 are anchored to the foundation by anchor bolts 18. The first end stand 12 is shown as an entry stand, the third end stand 16 is shown as an exit stand and the second end stand 14 is shown as an intermediate stand. It should be appreciated from the drawings that the entry and exit stands are substantially identical and merely pivoted 180° with respect to each other. A trough 20 extends between the stand 12 and stand 14 and a second trough 20 extends between the stand 14 and stand 16. Each trough 20 is anchored to the foundation by bolts 18 at substantially the center of the trough 20, allowing the trough to expand evenly on either side of the anchor. The anchoring of the trough 20 provides for substantially even expansion of the trough 20 on each side of the anchor point.

Each trough 20 is adapted to receive pickling acid therein for pickling the work product, such as carbon or stainless steel strip or the like. The pickling acid is supplied to the interior of each trough in a conventional fashion, such as by a plurality of injection nozzles (not shown) extending through the sides of the trough 20. The pickling acid supply may also provide pickling acid to the trough from within each stand 12, 14 and 16.

Figure 2:
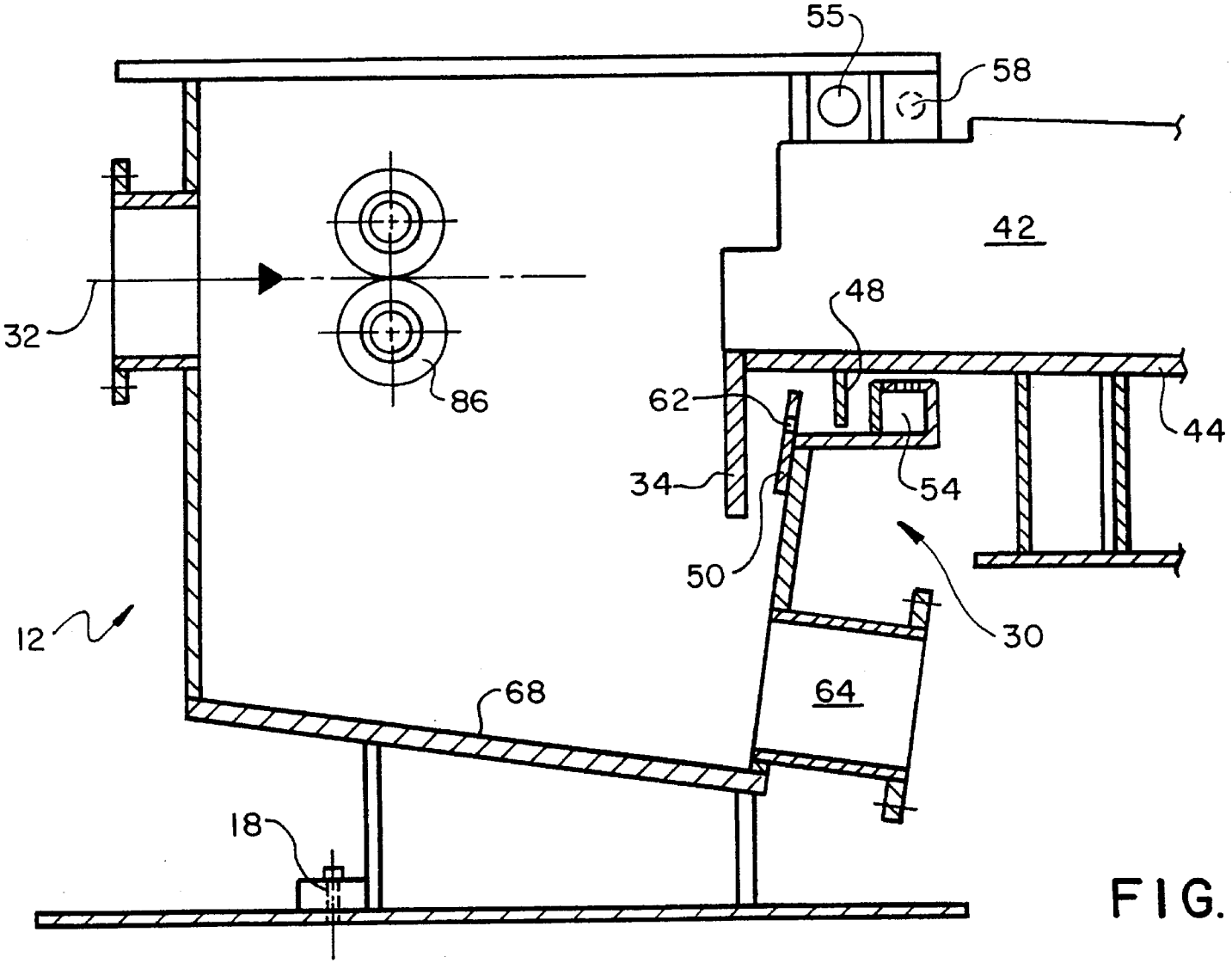
FIG. 2 is an enlarged schematic section side view of a front end stand of the pickling tank shown in FIG. 1.
Figure 4:
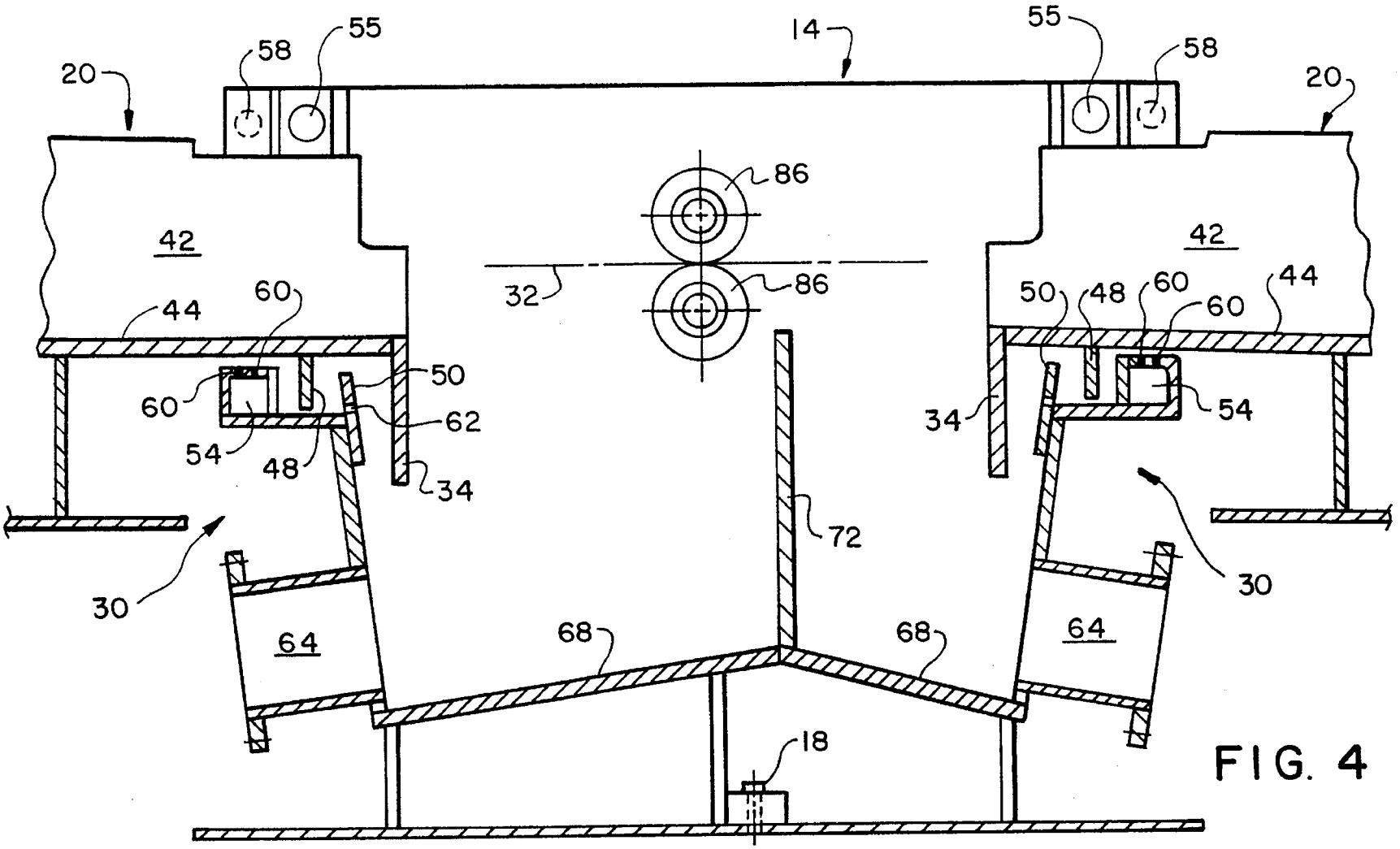
FIG. 4 is an enlarged schematic section side view of an intermediate stand of the pickling tank illustrated in FIG. 1.

As shown in FIGS. 2 and 4, the end flange 34 helps form an expandable labyrinth seal 30 positioned between the trough 20 and the stands 12, 14 and 16. The labyrinth seal 30 extends at least along the trough sides 42 and trough bottom 44 up to a cover (not shown) for the stands 12, 14 and 16. The labyrinth seal 30 is formed by four members including end flange 34 attached to the trough 20 and positioned within the interior of the stand 12, 14 or 16; intermediate flange 48 attached to trough 20; end stand flange 50 attached to the stand 12, 14 or 16; and fume plenum 54 also attached to the stand 12, 14 or 16 and positioned at an exterior side of the labyrinth seal 30. The end flange 34, intermediate flange 48, end stand flange 50 and fume plenum 54 overlap as illustrated in FIGS. 2 and 4 to form the labyrinth seal 30, preventing the migration of pickling acid therethrough. The labyrinth seal 30 is constructed with sufficient space between the end flange 34, intermediate flange 48, end stand flange 50 and fume plenum 54 to allow for thermal expansion of the trough 20. The thermal expansion of the trough 20 becomes particularly significant since the trough 20 and end stands 12, 14 and 16 are preferably formed of stress-relieved, virgin polypropylene (PP). A 40–60 foot trough section formed of polypropylene can be expected to expand 3–5 inches when operating under the elevated operating conditions of the pickling acid. The labyrinth seal 30 of the present construction accommodates this thermal expansion while maintaining seal integrity and an appropriate relative position between the trough 20 and the end stands 12, 14 and 16. A flushing coupling 55 is provided on the stand 12, 14 or 16 adjacent the fume plenum 54 which allows for the flushing of the labyrinth seal 30 with cleaning fluid, such as water, to prevent buildup in the labyrinth seal 30. The end stand flange 50 is lower than the height of the fume plenum 54 to allow cleaning fluid to flow into the interior of the stand 12, 14 or 16 during flushing.

Figure 3:
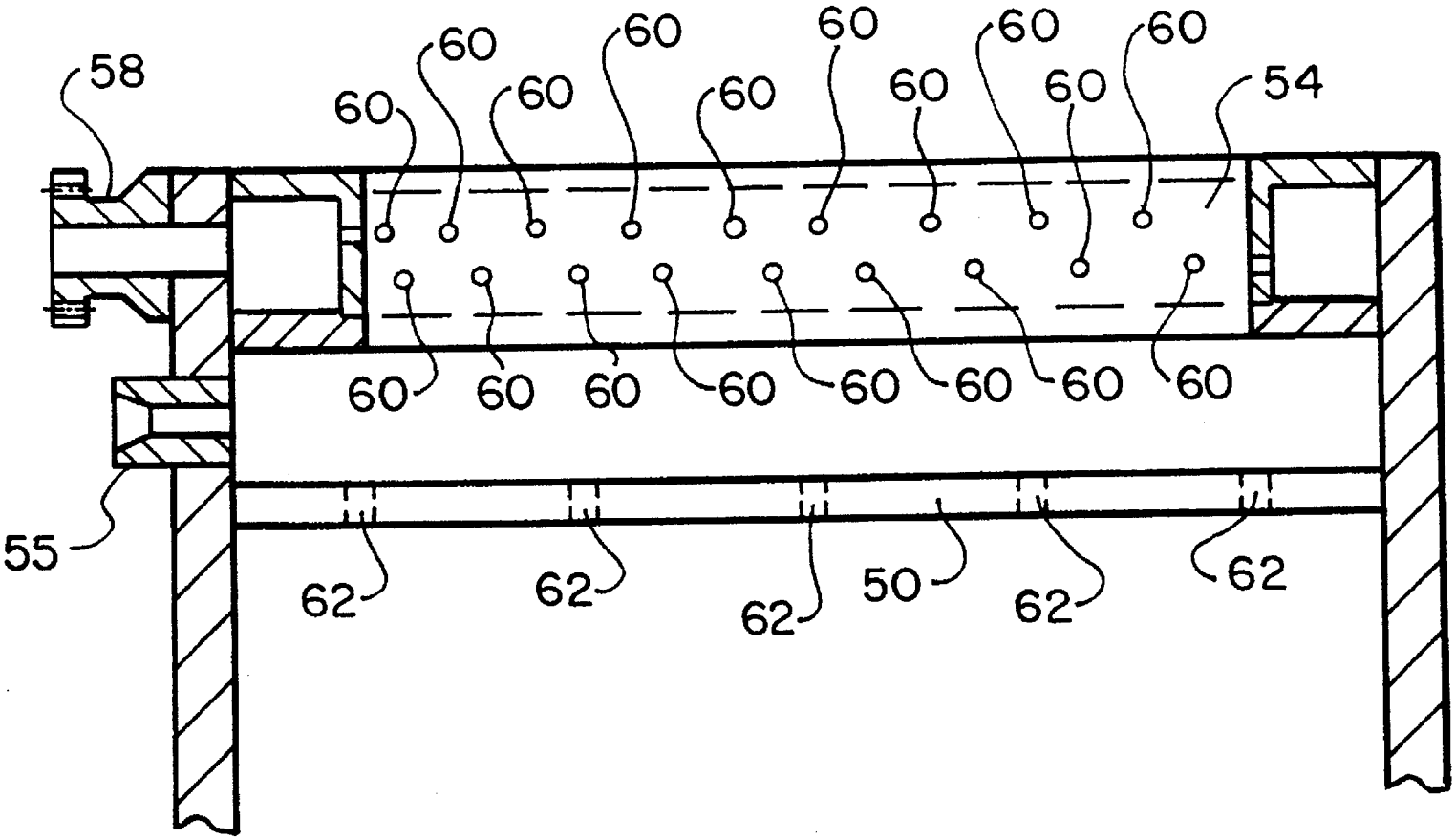
FIG. 3 is an enlarged schematic top view of a seal portion of the front end stand shown in FIG. 2.

The fume plenum 54 is attached to a conventional suction fan (not shown) through a fume exhaust connection 58 schematically illustrated in FIG. 3. The fume plenum 54 includes a plurality of holes or slots 60 therein which are sufficiently sized to achieve a capture velocity sufficient to exhaust all of the fumes coming through labyrinth seal 30 from the interior of the stands 12, 14 and 16. The fume plenum 54 eliminates the escape of pickling acid fumes from the seal area of pickling tank 10. Additionally, labyrinth seal 30 includes a plurality of weep holes 62 within end stand flange 50 which extends into the interior of the stand 12, 14 or 16. The weep holes 62 allow condensation or other liquid in the interior of the labyrinth seal 30 to be weeped into the interior of the stand 12, 14 or 16.

Pickling acid flowing into the stands 12, 14 and 16 can flow out of drain 64 positioned at the bottom thereof. Each drain 64 is adapted to be coupled to a recirculation system to provide for recirculation of the pickling acid through the pickling tank 10. Each drain 64 is an appropriate size for maintaining a constant recirculation of pickling acid. A bottom surface 68 of each stand 12, 14 and 16 is sloped toward the drain 64. The second or intermediate stand 14 includes a baffle 72 positioned to maintain a separation between the pickling acid in the first trough 20 and the pickling acid in the second trough 20 as shown in FIG. 4. Additionally, a trough outlet drain 74 is provided in the trough 20 and is adapted to be connected to the recirculation system. As with drains 64, the bottom 44 of the trough 20 is sloped toward the trough outlet drain 74.

A conventional cover (not shown) will be positioned over the trough 20 and stands 12, 14 and 16 to provide a contained sealed environment for the pickling tank 10. Each stand 12, 14 and 16 includes openings at the front and rear portions thereof with each opening surrounding the pass line 32 for allowing the work product to pass therethrough. At least one of the openings is adapted to receive the trough 20 therein and form the labyrinth seal 30 as described above. As shown in FIG. 1, at the entry and exit of the pickling tank 10, an opening is formed in the stands 12 and 16 which does not receive a trough 20 therein and which closely surrounds the pass line 32 to help maintain a closed environment for the pickling tank 10.

Each stand 12, 14 and 16 may include a pair of conventional wringing rolls 86 or a support roll positioned therein along the pass line 32. The wringing rolls 86 may be driven or free rolling and help support the workpiece in the pickling tank 10.

The pickling tank 10 of the present invention provides a substantially plastic construction to minimize the cost and improve the corrosion resistance of the overall pickling tank. The present invention can apply to thermoplastic tanks other than polypropylene (PP) such as PVC, CPVC and PE. Additionally, the unique construction of the present design accommodates the thermal expansion of the trough 20 while maintaining proper relative positioning of the trough 20 relative to the wringing rolls 86 and end stands 12, 14 and 16 and further maintaining appropriate containment of the pickling acid through expandable labyrinth seal 30 with fume plenum 54. The described embodiment is intended to be illustrative of the present invention, and the present invention should not be limited thereto. It should be apparent to those of ordinary skill in the art that various modifications may be made to the present invention without departing from the spirit and scope thereof. Consequently, the scope of the present invention is intended to be defined by the attached claims.

What is claimed is:

1. A shallow bath pickling tank comprising:

first and second end stands spaced from each other and secured to a foundation;

a trough extending between said end stands adapted to receive a pickling acid therein; and an expandable seal coupling each said end stand with said trough, each said seal allowing for thermal expansion of said trough relative to said stand.

2. The pickling tank of claim 1 further comprising:

a third end stand spaced from said second end stand secured to said foundation; and a second trough extending between said second end stand and said third end stand.

3. The pickling tank of claim 1 wherein said trough is formed substantially of polypropylene.

4. The pickling tank of claim 1 wherein each said seal is a labyrinth seal extending along at least a bottom and two sides of said trough.

5. The pickling tank of claim 4 wherein said labyrinth seal includes at least one weep hole extending into an interior of said end stand.

6. The pickling tank of claim 4 wherein said labyrinth seal further includes a fume plenum at an exterior end of each said labyrinth seal, said fume plenum including a plurality of fume entrance holes therein.

7. The pickling tank of claim 6 wherein each said labyrinth seal is formed by an end flange and intermediate flange extending from said trough and an inner flange and said fume plenum extending from said end stand.

8. The pickling tank of claim 7 wherein said fume plenum extends higher than said inner flange.

9. The pickling tank of claim 1 wherein each said end stand further includes a flushing coupling therein adapted to allow said seal to be flushed with cleaning fluid.

10. The pickling tank of claim 1 wherein each said end stand includes an entry opening on a front end thereof and an exit opening on a rear end thereof surrounding said pass line permitting a workpiece to pass therethrough.

11. The pickling tank of claim 1 wherein said trough is anchored to said foundation at substantially a center of said trough wherein said trough is adapted to move relative to said foundation through expansion of said trough on either side of said anchor.

12. The pickling tank of claim 1 wherein each said end stand includes a drain positioned therein.

13. The pickling tank of claim 12 wherein at least a portion of a bottom surface of an interior of said end stand is sloped toward said drain.

14. The pickling tank of claim 1 wherein said seal allows thermal expansion of said trough up to about 5 inches.

15. The pickling tank of claim 1 wherein said trough includes a drain positioned therein, and wherein at least a portion of a bottom surface of said trough is sloped toward said trough drain.

16. A continuous shallow bath pickling tank for carbon or stainless steel products, said bath comprising:

a first polypropylene end stand secured to a foundation and adapted to have the product pass therethrough;

a second polypropylene end stand spaced from said first end stand and secured to said foundation, said second end stand adapted to have the product pass therethrough;

a polypropylene trough extending between said end stands adapted to receive a pickling acid therein, said trough anchored to said foundation at a center section of said trough; and an expandable labyrinth seal coupling each said end stand with said trough, each said seal allowing for thermal expansion of said trough relative to each said end stand.

17. The pickling tank of claim 16 wherein each said labyrinth seal is formed by an end flange and intermediate flange extending from said trough and an inner flange and a fume plenum extending from said end stand.

18. The pickling tank of claim 17 wherein each said end stand further includes a flushing coupling therein adapted to allow said seal to be flushed with cleaning fluid.

19. The pickling tank of claim 18 wherein said fume plenum extends higher than said inner flange, whereby cleaning fluid may flow over said inner flange and into an interior of said end stand.

* * * * *